US005127718A

United States Patent [19]

Paine et al.

[11] Patent Number: 5,127,718

[45] Date of Patent: Jul. 7, 1992

[54] MUSEUM DISPLAY CASE HAVING IMPROVED AIRTIGHT SEAL

[75] Inventors: Shelley R. Paine, 606 Fatherland St., Nashville, Tenn. 37206; Ralph W. Scott, Bon Aqua, Tenn.

[73] Assignee: Shelley R. Paine, Nashville, Tenn.

[21] Appl. No.: 605,799

[22] Filed: Oct. 30, 1990

[51] Int. Cl.[5] ..... A47B 88/00

[52] U.S. Cl. ..... 312/114; 312/296

[58] Field of Search ..... 312/296, 114, 31, 38.1, 312/1

[56] References Cited

U.S. PATENT DOCUMENTS

| | | | |
|---|---|---|---|
| 1,485,496 | 3/1924 | Elliott . | |
| 2,172,244 | 9/1939 | Grundler . | |
| 3,366,361 | 1/1968 | Gostling . | |
| 3,907,389 | 9/1975 | Cox et al. | 312/1 |
| 4,060,292 | 11/1977 | Medina . | |
| 4,082,390 | 4/1978 | Gibson et al. . | |
| 4,111,753 | 9/1978 | Folsom et al. . | |
| 4,339,047 | 7/1982 | Johansson et al. . | |
| 4,553,680 | 11/1985 | Griggs et al. . | |
| 4,684,097 | 8/1987 | Cox . | |
| 4,744,611 | 5/1988 | Tamura et al. . | |
| 4,749,241 | 7/1988 | Thoreson et al. . | |
| 4,796,864 | 1/1989 | Wilson . | |

OTHER PUBLICATIONS

Stolow, N., "The Microclimate: A Localized Solution", *Museum News*, Nov./Dec. 1977, pp. 52-63.

Stolow, N., "Fundamental Case Design for Humidity Sensitive Museum Collections", *Museum News Technical Supplement*, Feb. 1966, No. 11, pp. 45-52.

Rothe et al., "Climate Controlled Show-Cases for Paintings", *Museum*, vol. 37, No. 2, 1985, pp. 89-90.

Ramer, B., "Show-Cases Modified for Climate Control", *Museum*, vol. 37, No. 2, 1985, pp. 91-94.

Guichen et al., "Controlling the Atmosphere for 197 Musical Instruments", *Museum*, vol. 37, No. 2, 1985, pp. 95-98.

Selzer, W., "Flexibility: A New Flexible Display System", *Museum*, vol. 37, No. 2, 1985, pp. 108-111.

Padfield, T., "A Cooled Display Case", *Museum*, vol. 37, No. 2, pp. 102-103, 1985.

*Primary Examiner*—Joseph Falk

*Attorney, Agent, or Firm*—Welsh & Katz, Ltd.

[57] ABSTRACT

A sealed display and storage case is disclosed for viewing and storing a museum piece or the like in a protected and controlled environment. The display case includes a base having apertures therethrough, a top cover, and a bottom cover. A first seal mechanism attaches the top cover to the base, providing an upper microclimate chamber, and a second seal mechanism attaches the bottom cover to the base, providing a lower microclimate chamber. The apertures within the base limit air flow exchange between the upper and lower microclimate chambers. A rotatable disc mechanism is used to close the apertures when either cover is removed for servicing, thereby eliminating outside air flow into the unopened microclimate chamber. The humidity buffer is contained within an open vessel having an externally adjustable lid, thereby providing a way to adjust the microclimates without any outside air flow into the chambers.

41 Claims, 4 Drawing Sheets

MUSEUM DISPLAY CASE HAVING IMPROVED AIRTIGHT SEAL

FIELD OF THE INVENTION

The present invention generally relates to display and storage enclosures for viewing or storing a museum piece or the like. More particularly, the present invention pertains to enclosures requiring an adjustable and predictable microclimate, wherein airtight seals are used for maintaining the enclosed object in a protected and controlled environment.

BACKGROUND OF THE INVENTION

It is well known that museum pieces, such as works of art, ancient manuscripts, archeological objects, etc., can be sensitive to the surrounding environmental conditions of humidity, temperature, and even microorganisms in the air. Thus, exposing the display piece to the surrounding environment can result in the object's degradation over an extended period of time. It is for this reason that many articles are displayed in a glass or plastic case which has some mechanism to control the environment within the case.

The interior environmental condition of a small enclosure is called a microclimate. Such an enclosure with a controllable microclimate is ideal for displaying or storing sensitive objects. One common type of display enclosure known in the art has a removable transparent cover, a stand which supports the object on display, and a seal under the cover for limiting outside air flow to and from the microclimate. The display case microclimate is typically controlled by a humidity buffer, usually silica gel, carried in an open vessel within the enclosure. Silica is an inert material having a pre-conditioned value for the absorption and desorption of moisture. The silica gel maintains a constant relative humidity level within the microclimate.

However, leakage of outside air into the microclimate through the seal or cover, which often occurs after a period of time, causes the silica gel to reach equilibrium with the outside air and disrupts the controlled microclimate. If the seal is inadequate, leaks can disrupt the microclimate quite rapidly. Restoration of the microclimate to the desired condition generally requires the removal of the seal and the replacement of the humidity buffer. Access to the humidity buffer often requires removal of the seal in order to remove the display cover, thereby exposing the object on display to the outside air. Once a seal is removed, it generally does not provide proper airtight sealing upon re-use. Hence, the seal must often be replaced. Therefore, maintenance of the typical sealed museum display case is a significant problem, particularly when servicing is required every few months.

Another prior art display case maintains a sealed microclimate by attaching a metal frame around the lower edge of the display cover. The frame has one or more grooves for holding a seal. The frame is screwed to a base, resulting in a seal between the base and the cover. However, subsequent removal of the cover to maintain the humidity buffer to restore the desired microclimate conditions requires the removal of a number of screws. This removal procedure results in the exposure of the display object to the outside air for at least a few minutes, thereby disturbing the controlled microclimate. Additional problems in this type of case are often caused by human error in fastening the frame to the base. Each screw causes a deformation or stress point on the O-ring seal, because each screw cannot be fastened with exactly uniform torque. Consequently, this prior art sealing mechanism often allows constant leakage of the outside air to the microclimate.

Still another type of prior art display case provides a separate lower chamber for the humidity buffer, located under the support platform for the object on display. In some designs, this lower chamber consists of shelves or a pan built into the supporting pedestal or stand, with a large access port for servicing the humidity buffer. In another design, the lower chamber has an internal sloping shelf, a first access port adjacent to the upper edge of the shelf, a second access port adjacent to the lower edge of the shelf, and a number of humidity buffer cylinders resting on the shelf. To replace a humidity buffer, the two ports are opened and the humidity buffer adjacent to the lower shelf edge is removed through the access port. The humidity buffer cylinders then roll down the shelf, providing a space at the top edge of the shelf wherein a new cylinder can be placed.

Although the aforementioned display case is somewhat effective in maintaining the internal microclimate, it still allows a significant amount of outside air flow to enter the display case through the access ports each time the case is serviced. Additionally, cylindrically-shaped humidity buffers must be used in order to roll down the slanted shelves. Furthermore, this elaborate humidity buffer replacement technique must be designed and constructed into the display case, i.e., it cannot be retrofit into an existing display case. Moreover, this type of display case cannot be removed as a sealed unit from its pedestal base.

This type of prior art display case also has interengaging adjustable latches, which maintain a frame and seal against the base. The frame includes a U-shaped groove, which mates with a deformable gasket affixed to the lower edge of the top cover. Latches of this type can often result in uneven tension on the seal. Moreover, the adjustment to the latches allows for unpredictable clamping pressure to be exerted on the seal.

Thus, problems presently exist with the seals and with access to the humidity buffer. Inadequate seals result in the need for frequent service or replacement of the humidity buffer. Previous means of access to the humidity buffer result in exposure of the art object to the outside air. Further, access to the object results in exposure of the humidity buffer to the outside air. Therefore, a need exists for an improved display case which minimizes the need for constant servicing of the humidity buffer, and which simplifies the maintenance and storage procedures.

OBJECTS AND SUMMARY OF THE INVENTION

It is a general object of the present invention to overcome the problems of the prior art set forth above.

A more specific object of the present invention is to provide a display case having a removable top cover which allows for access to the object on display, without significantly disturbing the microclimate of the humidity buffer.

A further object of the present invention is to provide a display case having a removable bottom cover which facilitates the servicing of the display case when replacing or modifying the humidity buffer, without significantly disturbing the microclimate of the object on display.

Another object of the present invention is to provide an improved display case seal mechanism that maintains a uniform, airtight seal which also permits quick access to the humidity buffer.

An additional object of the present invention is to provide a mechanism for controlling the microclimate within the display case without opening the display case.

Still another object of the present invention is to provide a display case humidity buffer chamber which can be adapted to an existing display case.

According to the invention, an airtight sealed enclosure is provided for viewing a museum piece or the like in a protected and controlled environment. The enclosure has a base with at least one aperture disposed therethrough, a top cover, and a bottom cover. The top cover is positioned above the base, and provides an upper microclimate chamber for the museum piece. The bottom cover is positioned below the base, and provides a lower microclimate chamber for the humidity buffer. The top and bottom covers are attached to the base by separate seal mechanisms. The base has at least one aperture, which limits the air flow exchange between the upper and lower microclimate chambers. The bottom cover preferably includes at least one access port for attaching a microclimate measuring device or a leak detecting device or an external environmental control mechanism. Removable containers are disposed within the bottom cover for holding a humidity buffer. An adjusting mechanism, coupled to a humidity buffer container, provides for the control of the microclimates without removing the bottom or top covers.

In a preferred embodiment, the top cover seal mechanism comprises a frame disposed along the perimeter of the lower edge of the top cover. The frame has a first lengthwise groove or well adapted for holding a sealant, such that both the bottom and inside surfaces of the lower edges of the top cover are secured to the frame by the sealant. Furthermore, the frame has a second lengthwise groove, positioned in the exterior surface of the frame, which cooperates with a clamp mechanism to fasten the frame to the base. Finally, the frame has a third lengthwise groove positioned in the bottom surface of the frame, which allows for the placement of a compressible O-ring seal. The clamp mechanism and frame are engineered such that the O-ring is compressed only a predetermined amount when the frame is properly attached to the base, thus providing an airtight seal after repeated use, and further providing a seal which cannot be overtorqued to cause O-ring failure or frame distortion. Moreover, the clamp mechanism can be adapted to any security system used for the display case.

In the preferred embodiment, the bottom cover seal mechanism includes a shaft centrally disposed through the base and the bottom cover. The perimeter edge of the bottom cover includes a flexible seal disposed between the bottom cover and the underside of the base. The centrally-disposed shaft and the flexible seal are the only attachment of the bottom cover to the base, thus allowing the bottom cover to be removed with minimum or no disturbance to the upper microclimate chamber. The second seal mechanism limits the amount of compression applied to the flexible gasket, thus preventing leaks due to overtightening.

In one embodiment, a rotatable disc, mounted under the base and having corresponding apertures, closes the base apertures to prevent air flow exchange between the microclimate when either the top or bottom cover is removed.

BRIEF DESCRIPTION OF THE DRAWINGS

These and other objects, features, and advantages of the invention will become clearer and more fully understood when the following detailed description is read in conjunction with the accompanying drawings, in the several figures of which like-referenced numerals identify like elements, and in which.

DESCRIPTION OF THE PREFERRED EMBODIMENT

Figure 1:
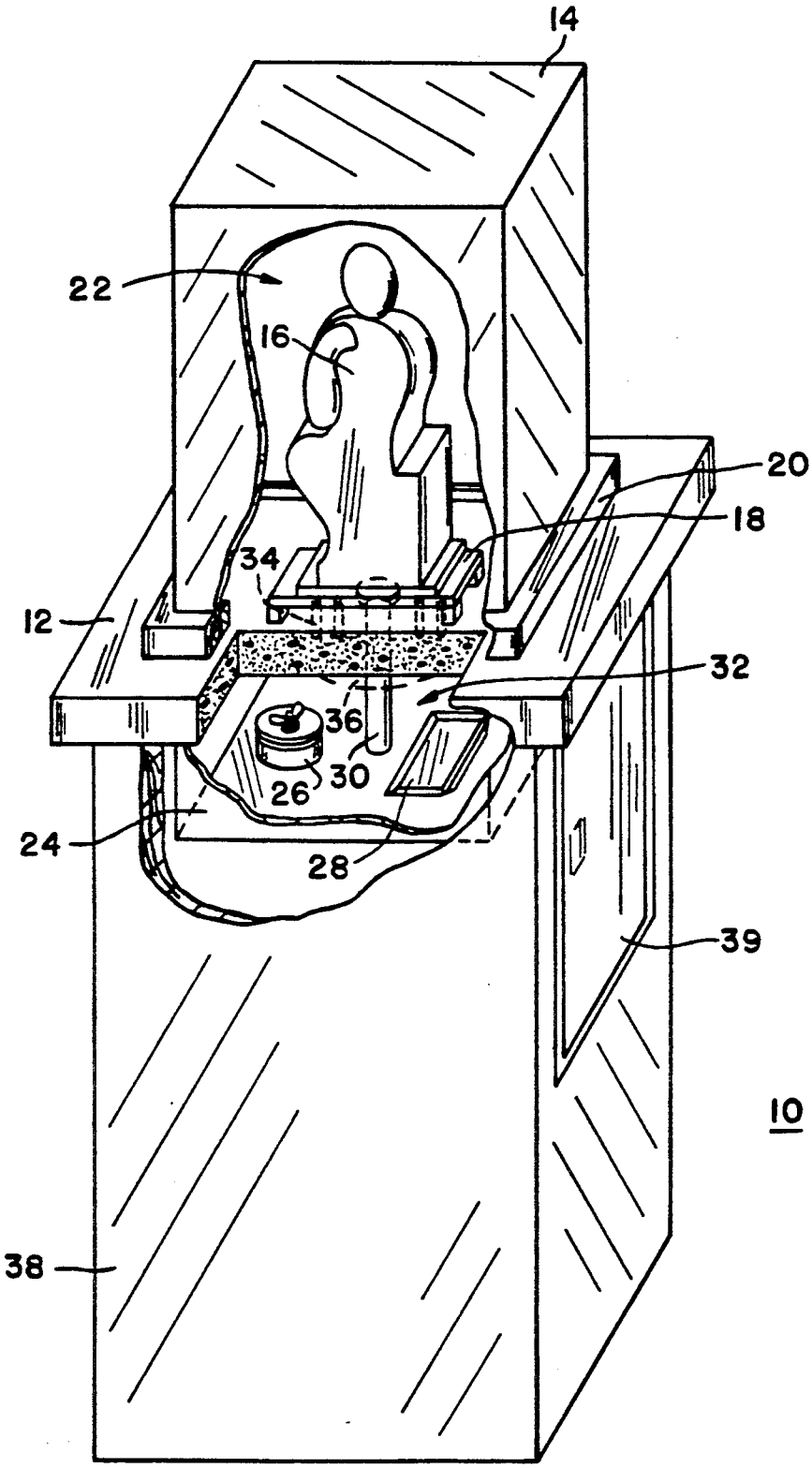
FIG. 1 is a perspective view of a museum display case constructed in accordance with the preferred embodiment of the invention.

The preferred embodiment of the museum display and storage case is shown in FIG. 1, and is generally indicated by the numeral 10. The display case 10 includes a base 12, which, in the preferred embodiment, has a substantially planar configuration. A top cover 14 is positioned above the base as shown. The top cover 14 is substantially transparent, which allows for the viewing of a museum piece 16 resting on a stand 18. In the preferred embodiment, the base 12 is made of marble, and the top cover 14 is substantially cubical in shape and made of transparent plastic or glass. However, numerous other materials may be used as long as the materials do not contribute to the degradation of the museum piece on display. This would exclude the use of wood for the base or the covers, unless the wood was specially prepared for this purpose. Although the disclosed embodiments illustrate a showcase having a horizontally-oriented base, the invention can readily be used with other types of enclosures in substantially any orientation. For example, the invention could readily be used with paintings, documents, textiles, etc., which require the base to have a vertical orientation.

A first seal mechanism 20 is provided around the perimeter of the lower edge of the top cover 14 for attaching and sealing the top cover 14 to the base 12. The seal mechanism 20 prevents outside air flow into the upper microclimate chamber 22 located within the top cover 14. This seal mechanism will be described in detail below.

The display case 10 also has a bottom cover 24 positioned below the base 12. Humidity buffer containers 26, 28, which also will be described below in detail, are located within the bottom cover 24. The bottom cover 24 is attached to the base 12 by a second seal mechanism 30, which prevents the outside air flow into the lower microclimate chamber 32 located within the bottom cover 24. The bottom cover 24 is preferably constructed of stainless steel, since other metals may introduce oxidation problems. Anodized aluminum is an alternative for cost and weight considerations.

The second seal mechanism 30 provides for the uniform sealing of the bottom cover 24 to the underside of the base 12. Although not fully shown in FIG. 1, the second seal mechanism 30 includes an O-ring seal around the perimeter of the upper edge of the bottom cover 24, and further includes a central shaft which provides quick removal and access to the inside of the bottom cover 24. These features will be described in the following figure. The second seal mechanism 30 can also include a magnetic frame or sliding drawer arrangement for attaching the bottom cover 24 to the base 12.

The base 12 has at least one aperture 34 disposed therethrough. The aperture 34 provides a limited air flow exchange between the upper and lower microclimate chambers 22 and 32, respectively, thus allowing the humidity buffer to stabilize the upper microclimate 22. During the maintenance and servicing of one embodiment of the display case 10, a disc 36 is rotated to close the aperture 34, thereby preventing any disturbance of the upper microclimate 22 when the bottom cover 24 is removed. The rotatable disc 36 would keep the aperture 34 closed during the time the bottom cover is removed for replacement of the humidity buffer, and for a time thereafter until the lower microclimate has re-stabilized. Hence, the rotatable disc 36 serves to isolate one microclimate from the other when either the top or bottom cover is removed for servicing, thereby eliminating outside air flow into the unopened microclimate chamber.

The stand 18 for the museum piece 16 is positioned above the apertures 30, further limiting air flow exchange. For purpose of aesthetics, fabric may also be placed under the stand 18, thus concealing the apertures 30 from view. The base 12 is preferably supported by a pedestal 38, being either supported on its underside as shown in FIG. 1, or contained entirely within the pedestal as shown in a later figure. The bottom cover 24 is preferably constructed such that it is disposed entirely within the pedestal 38 as illustrated. An access panel 39 in the pedestal 38 allows for adjustment of the bottom cover 24 or for control of the humidity buffer 26. Not only does this arrangement provide an aesthetically pleasing display, but it also permits the invention to be retrofit into an existing museum display case. Moreover, this arrangement permits the entire display case body, i.e., top cover 14, base 12, and bottom cover 24, to be removed as a unit from the pedestal 38 for storage.

Figure 2:
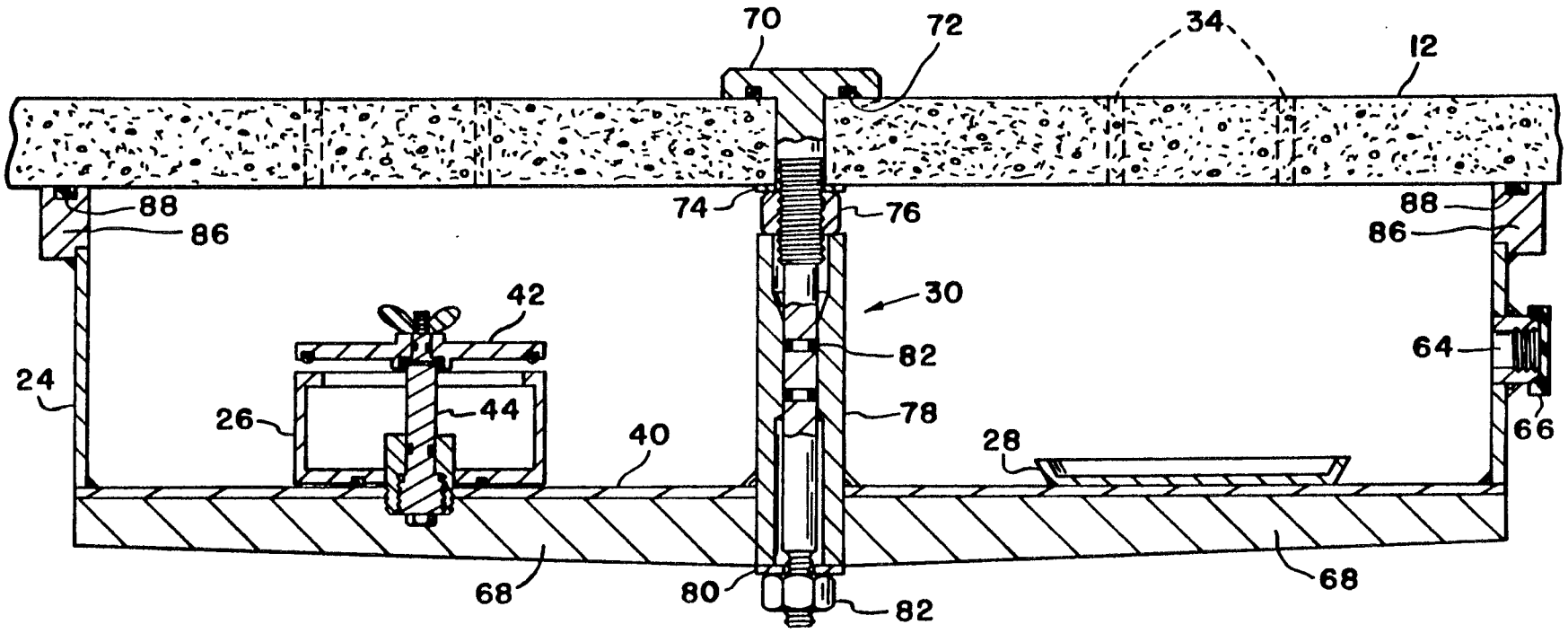
FIG. 2 is an exploded cross-sectional view of the base and bottom cover of FIG. 1, which illustrates the placement of the humidity buffers.

Referring now to FIG. 2, a cross-sectional view of the base 12 and bottom cover 24 is shown. In this embodiment, the bottom cover 24 has a rectangular bottom surface 40 and sides with an open interior which defines the lower microclimate chamber 32. The bottom cover 24 further includes a plurality of removable containers 26, 28, disposed within the base, for holding a humidity buffer. As used herein, humidity buffers would also include fungicides, insecticides, moldicides, water, or any other environment-altering substance. The humidity buffer generally used is silica gel which has been pre-conditioned to maintain a particular environment.

Almost any type of container can be used to hold the humidity buffer. For example, container 28 is a flat, open pan, similar to pans used as photographic trays. However, in the preferred embodiment, another type of container is generally shown in FIG. 2, and particularly illustrated in FIG. 3.

Figure 3:
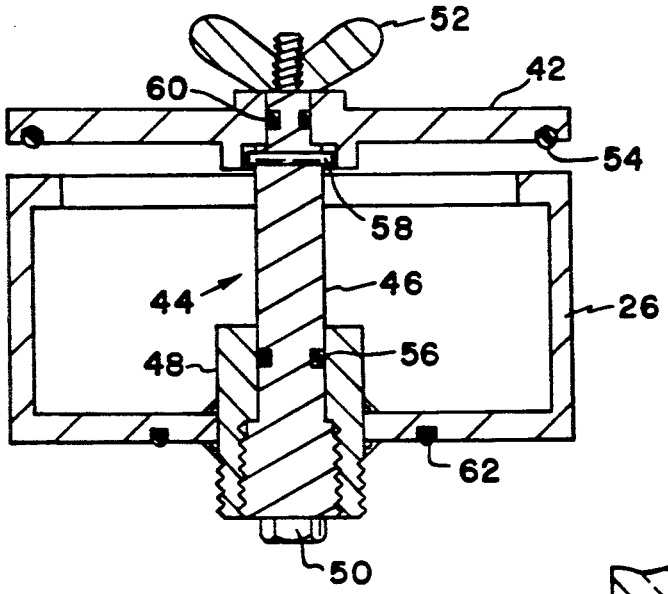
FIG. 3 is an exploded cross-sectional view of the open vessel humidity buffer shown in FIG. 2.

As shown in FIG. 2, an open vessel 26, having a lid 42, is used for containing the humidity buffer and for controlling its exposure. The lid 42 is raised and lowered by screw mechanism 44, the bottom end of which is accessible from outside the microclimate chamber through the bottom surface 40 of the bottom cover 24. In the preferred embodiment (as shown in FIG. 3), the screw mechanism 44 includes a bolt 46, which extends through a threaded bushing 48 of the vessel 26 and terminates in a removable nut 50. The nut 50, when turned from the outside, raises and lowers the lid 42. The raising of the lid 42 exposes more of the contents of the open vessel 28 to the lower microclimate chamber 32. Hence, the lower microclimate chamber 32 can be controlled without removing of the bottom cover 24.

A wing nut 52 is attached to the other end of the bolt 46, thereby allowing complete access to the vessel 28 when the lid 42 is removed. An O-ring 54 provides a seal between the lid 42 and the vessel 28 when in the closed position. Another O-ring 56 is positioned around the lower end of bolt 46 within the threaded bushing 48. A roll pin 58, located within a recess on the underside of the lid 42, supports the lid in an open position. Another O-ring 60 is disposed around the upper end of the bolt within the lid 42. Finally, the bottom of the vessel 26 also has at least one O-ring 62 recessed therein, for preventing leakage between the open vessel 26 and the bottom surface 40 of the bottom cover 24.

Again referring to FIG. 2, the bottom cover 24 also has provisions for an alternative microclimate control technique. The bottom cover 24 includes at least one access port 64, preferably threaded, for attaching an external mechanism for controlling the environment, or for attaching a measuring device. Such an external mechanism for controlling the environment would include a pump, fan, or other device for circulating environmentally-controlled air in to and/or out from the bottom cover 24. A measuring device, such as a thermometer, barometer, manometer, or hygrometer, or any other device used for measuring environmental conditions, can also be coupled to the access port 64. A cap 66 can be used to seal the access port 64 when not in use.

As further illustrated in FIG. 2, the second seal mechanism 30 includes a shaft centrally disposed through the base 12 and the bottom cover 24. The underside of the bottom cover 24 includes a plurality of vertical ribs 68 to provide support such that the cover does not flex. This centrally-disposed shaft arrangement provides a quick and easy mechanism for allowing the bottom cover 24 to be removed with minimum or no disturbance to the upper microclimate chamber 22. The second seal mechanism 30 includes a top bolt 70 with at least one gasket or O-ring 72 disposed on the undersurface of the bolt 70 as shown. The bolt 70 extends through the base 12 and through a flat washer 74, and is secured by a first nut 76. The bolt 70 further extends through a central shaft 78 and through the bottom cover 24, and terminates with a second washer 80 and a second nut 82. The bolt 70 also has at least one O-ring 82 disposed around a recessed groove in the center portion of the bolt 70, which serves to prevent air from entering between the bolt 70 and the shaft 78 and passing into the lower microclimate chamber 32.

The perimeter of the top edge of the bottom cover 24 has a grooved flange 86 which contains an O-ring seal 88. When the second nut 82 on the underside of the bottom cover 24 is fastened, the O-ring seal 88 is compressed, and an airtight seal between the bottom cover 24 and the base 12 is formed. In the preferred embodiment, the shaft 78 prevents over-tightening of the O-ring 88 because the precise length of the shaft 78, when in contact with the first nut 76, has been engineered to limit the amount of compression when the second nut 82 is fastened.

Figure 4:
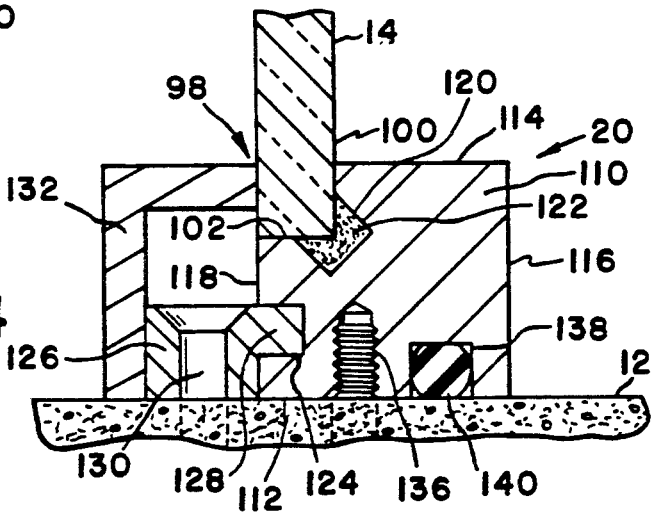
FIG. 4 is an exploded cross-sectional view of the preferred embodiment of the first seal mechanism shown in FIG. 1.

Turning now to FIG. 4, a partial cross-sectional view of one side of the top cover 14 and the first seal mechanism 20 is shown. The side of the top cover 14 has a lower edge 98 around the perimeter, each lower edge having an inner surface 100 and a bottom surface 102 as shown. The first seal means 20 includes a frame 110 which is disposed around the perimeter at the lower edge 98 of the top cover 14. The frame 110 has a bottom surface 112, a top surface 114, interior surface 116, and an exterior surface 118 as shown. Only a portion of the exterior surface 118 is disposed outside the top cover 14, while the body of the frame 110 is disposed inside the top cover 14.

In the preferred embodiment, the frame 110 has a first groove 120 approximately encompassing the corner of the frame which lies between the top surface 114 and the exterior surface 118. The first groove 120 is shaped such that it defines a well 122 which provides a reservoir adapted for holding a sealant. In other words, the first groove has a cross-sectional shape which does not correspond exactly with the cross-sectional shape of the lower edge 98 of the top cover, as shown in the figure. The well 122 is dimensioned such that at least a part of both the lower surface 102 and the inner surface 100 of the lower edge 98 are in contact with the sealant and thereby secured in the frame. In the preferred embodiment, the frame is constructed of anodized aluminum, and silicon adhesive is used as the sealant contained within the first groove 120. Depending upon the materials used, the frame can be welded, glued, or screwed together.

A second groove 124 is located in the exterior surface 118 of the frame 110 below the first groove 120. The second groove 124 provides a space for mating with a clamp member 126, which is used to fasten the frame 110 to the base 12. The clamp member 126 includes a projection 128, which is adapted to be received in the second groove 124 of the frame 110. The clamp member 126 further includes a threaded aperture 130 for securing the clamp member 126 to the base 12 from above or below the base. The threaded aperture allows the clamp member 126 to be held down from above using a flathead screw, or, for added security, allows it to be held from under the base 12 using any type of screw.

Although the clamp member 126, in the preferred embodiment, is constructed as four continuous strips or elongated bars, each of which contains numerous apertures 130 for a plurality of screws, the frame could also be affixed to the base using a plurality of individual single-screw clamp members. In the latter case, it would not be necessary to have the second groove disposed in all portions of the frame. In order to conceal the clamp member 126 and/or provide additional security, a clamp cover 132 can be positioned over the clamp member 126 as shown. The clamp cover 132 may be held in place in any number of ways, e.g., internal clips, friction-fit, adhesive, etc. In this manner, the display case can be aesthetically pleasing to the viewer so as not to distract from the object on display.

The invention also facilitates the securing of the frame 110 to the base 12 without the use of the clamp member 126. In this embodiment of the invention, a threaded aperture 136 is located in the bottom surface 112 of the frame 110. A screw can be inserted from the underside of the base 12 into the aperture 136, thus fastening the frame 110 to the base 12. Of course, if this fastening technique is used, the clamp member 126 could be omitted or replaced with decorative trim.

A third groove 138 is located in the bottom surface 112 of the frame 110, and contains an O-ring seal 140 as shown. The O-ring seal 140 is dimensioned such that it is compressed within the groove 138 when the frame 110 is tightly secured to the base 112. The dimensions of the O-ring 140, the groove 138, and the clamp member 126 all contribute to the amount of compression on the seal. Note that the O-rings cannot be over-compressed by the user. However, if desired, the clamps may be loosened or the O-rings removed if airflow into the microclimate chamber is desired. As will be appreciated by those skilled in the art, any flexible seal or sealant may be used in place of any of the various O-ring seals described above.

Figure 5:
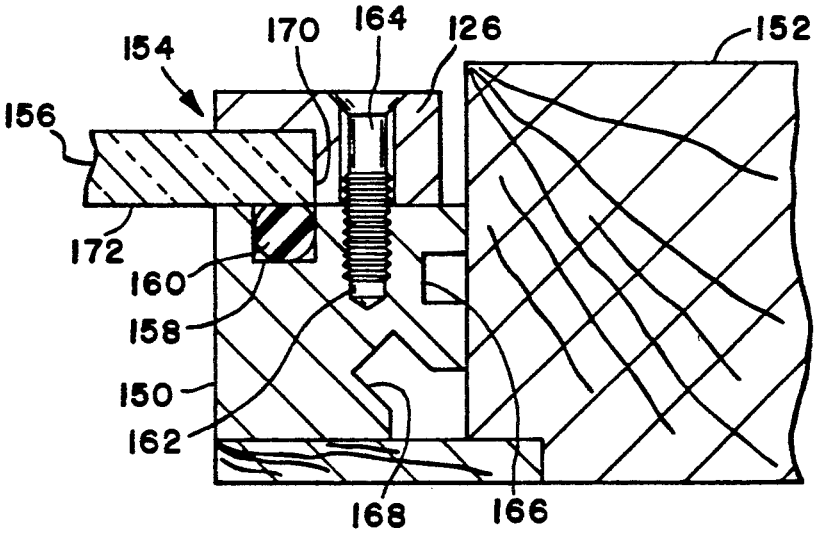
FIG. 5 is a cross-sectional view of an alternative embodiment of the seal mechanism shown in FIG. 4.

FIG. 5 illustrates another embodiment of the present invention, wherein a frame 150 has been adapted to fit a display case mounted in a wall 152. Instead of positioning the lower edge 98 of the top cover 14 of the display case 10 within the first groove 120 as in the previous figure, the side edge 154 of the display window 156 is positioned partially over the frame 150 and over a first groove 158 which contains an O-ring seal 160. The same clamp member 126 is then fastened over the side edge of the display window 156 to the frame. A threaded aperture 162 in the frame provides for the securing of the clamp member 126 to the frame 150 using a screw 164. Depending upon the configuration of the wall, the frame 150 may or may not have additional grooves 166 or 168. If desired, a sealant may be applied between the wall 152 and the frame 150 and/or a sealant may be disposed in groove 168. Moreover, the first groove 158 can also be constructed to have a well to contain sealant and touch both the end surface 170 and the inner surface 172 of the display window 156, as was the case for the groove 120.

It is important to note that frame 150, as depicted in FIG. 5, has the same cross-sectional configuration as frame 110 of FIG. 4, only shown in an inverted position. Hence, the frame of the seal mechanism can be constructed to be utilized for either the pedestal-type of display case 10, or the wall-mounted display window 156. This feature would prove to be advantageous in that it would only be necessary for the manufacturer, dealer, or museum to stock one type of frame stock.

Figure 6:
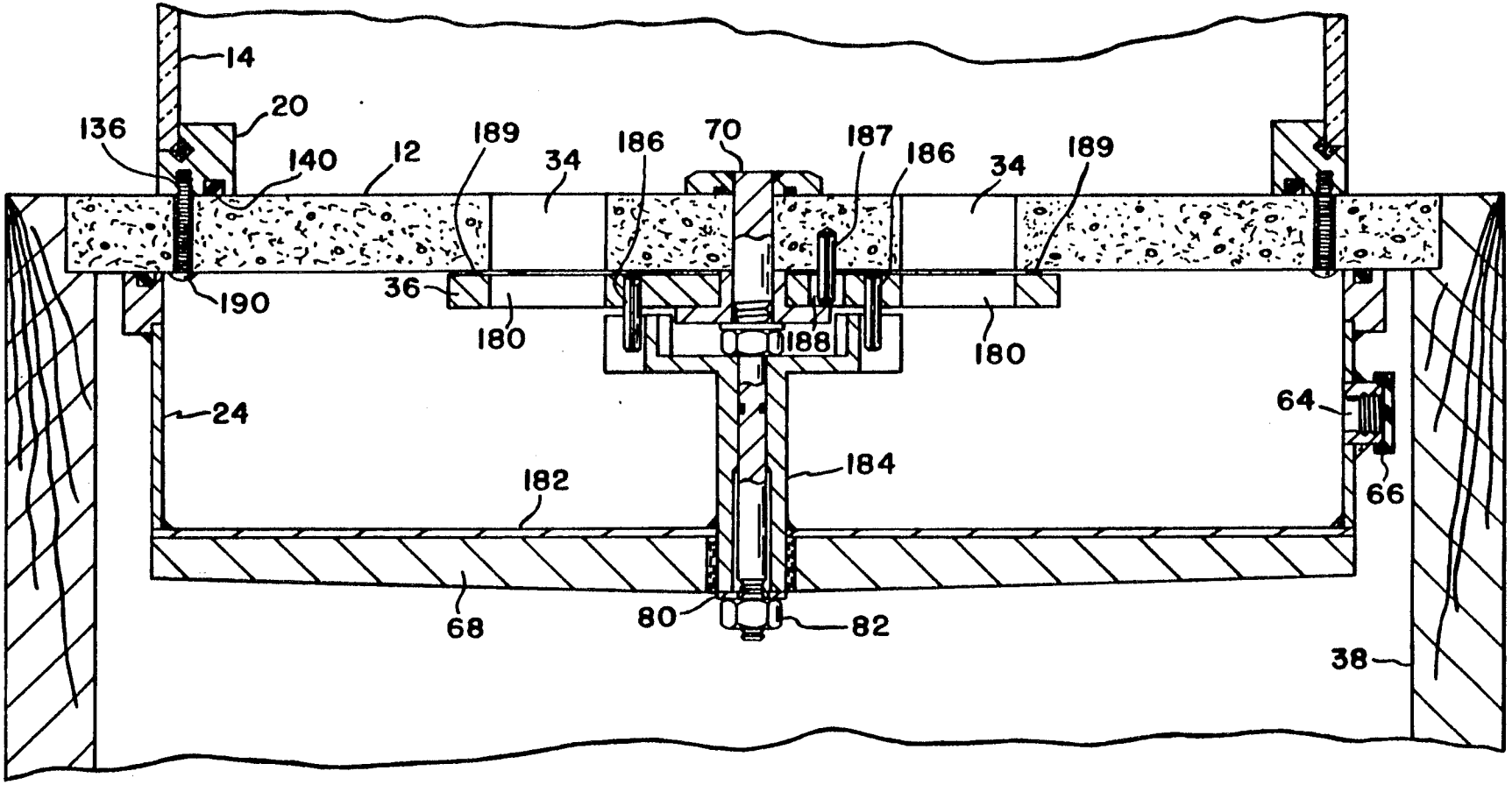
FIG. 6 is an exploded cross-sectional view of another embodiment of the base and bottom cover, which illustrate the placement of the rotatable disc.

Referring now to FIG. 6, an exploded cross-sectional view of another embodiment of the present invention is shown. In this embodiment, a rotatable disc mechanism 36 is used for sealing the upper microclimate chamber 22 from the lower microclimate chamber 32 when either cover is removed for servicing. The disc mechanism 36 has apertures 180 which correspond to base apertures 34 when the disc is in a position of alignment. The disc can then be slightly rotated from the inside or outside (as described below) to misalign the apertures and thereby close them. This feature allows for maintenance of the display case 10 when the bottom cover 24 is removed, without allowing any outside airflow into the upper microclimate chamber 22. Similarly, the disc mechanism 36 would be rotated to close the apertures when the top cover 14 is removed for servicing the museum piece 16. Alternatively, various types of plugs (not shown) may also be used to close the apertures in the base once the top or bottom covers are removed.

Note that on this embodiment, the bottom cover 24 is constructed to have a circular bottom 182 as opposed to the rectangular bottom 40 of FIG. 2. In order to rotate the disc 36 from the outside, one must first loosen nut 82, and then rotate the entire bottom cover 24 until it stops at approximately 45° of rotation. The rotation of the bottom cover 24 rotates central shaft 184, which, in turn, causes roll pins 186, affixed to both the shaft 184 and the rotatable disc 36, to rotate. A third roll pin 187 serves as a stop to terminate the rotation of the disc at approximately 45° of rotation. Roll pin 187 is securely mounted within the underside of the base 12, and fits in a slot 188 disposed within the rotatable disc 36. After 45° of rotation, the apertures 34 in the base 12 do not align with the apertures 180 in the rotatable disc 36, such that the apertures in the base are now closed. A number of O-ring seals 189 are located around each aperture 180 to prevent leaks. The bottom cover 24 can now be removed without disturbing the sealed upper microclimate chamber. Alternatively, once the bottom cover 24 is removed, the disc 36 can be rotated by gripping the two exposed roll pins 186. Note that a separate wrench can be used to open or close the apertures if the bottom cover is removed. Also note that it is not necessary for the operator to crawl under the display case, as removal of the bottom cover and operating the disc mechanism can be done by feel alone.

In the embodiment of FIG. 6, the base 12 is contained entirely within the sides of the pedestal 38, as shown. Either this arrangement, or that shown in FIG. 1 where the base rests on the upper edge of the pedestal 38, allows the entire display case body including the top cover, the base, and the bottom cover 24, to be removed from the pedestal 38 as a single unit for storage. Also note in FIG. 6 that the first seal mechanism 20 is affixed to the base 12 using internal screws 190 threaded into apertures 136. This arrangement not only provides added security, but also provides an aesthetically pleasing seal for the top cover 14. In this embodiment of the first seal mechanism, the second groove 124 has been omitted.

In review, it can now be seen that the present invention provides an airtight museum display case which can be adapted to an existing display case, and which is easily and quickly maintained. The invention provides for a component system of two separate microclimate chambers, which allows each one to be opened without exposing the other microclimate chamber to outside air, and which allows the entire display case to be removed as a unit from the pedestal for storage. Moreover, the improved seal mechanism provides an airtight seal for each individual microclimate chamber.

While specific embodiments of the present invention have been shown and described herein, further modifications and improvements may be made by those skilled in the art. For example, various other types of structures may be used to perform the aperture closing function of the rotatable disc. Moreover, the particular display case and seal mechanism embodiments disclosed above could readily be modified to fit other applications requiring controlled environmental conditions. Treatment cases, e.g., for humidity treatment of a museum piece having bronze disease, could also be constructed in accordance with the present invention. All such modifications which retain the basic underlying principles disclosed and claimed herein are within the scope of this invention.

What is claimed is:

1. A display apparatus adapted for containing and displaying an object in a protected and controlled environment, said display apparatus comprising:

a sealed enclosure including:

a base having at least two major surfaces, said base having at least one aperture disposed therethrough and forming at least one opening in each of said two major surfaces;

a first cover positioned adjacent a first of said two major surfaces of said base, said first cover and said base forming a first chamber enclosing said surface opening and adapted for containing said object on display, the size of said surface opening being substantially smaller than the size of said first chamber, said first cover having first seal means for attaching said first cover to said base, for providing a first microclimate chamber, and for preventing outside air flow into said first microclimate chamber;

a second cover positioned adjacent a second of said two major surfaces of said base, said second cover and said base forming a second chamber enclosing said surface opening, said second cover having second seal means for attaching said second cover to said base, for providing a second microclimate chamber, and for preventing outside air flow into said second microclimate chamber;

said display apparatus further comprising:

means for providing support to said sealed enclosure, said support means being attached to said base such that either of said first and second microclimate chambers is adapted to be opened without separating said base from said support means.

2. The apparatus according to claim 1, wherein said apparatus is adapted for storage of said object.

3. The apparatus according to claim 1, wherein said apparatus is adapted for treatment of said object.

4. The apparatus according to claim 1, wherein said second microclimate chamber includes at least one container having a humidity buffer.

5. The apparatus according to claim 1, further comprising means for adjusting said second microclimate without the removal of said second cover or said first cover.

6. The apparatus according to claim 5, wherein said adjusting means comprises an open vessel having a lid, said lid having screw means, at least partially accessible from outside said second microclimate chamber, for raising and lowering said lid.

7. The apparatus according to claim 1, wherein said aperture in said base provides only limited outside air flow into said first microclimate chamber when said second cover is removed from said base.

8. The apparatus according to claim 1, wherein said second seal means includes a shaft centrally disposed through said base and said second cover.

9. The apparatus according to claim 1, further comprising means for closing said aperture in said base.

10. The apparatus according to claim 1, wherein said second cover includes at least one access port means for attaching an external means for controlling said second microclimate.

11. The apparatus according to claim 1, wherein said first cover has at least one peripheral edge affixed to said first seal means, said edge having an end surface and at least one side surface adjacent to and substantially perpendicular to said side surface, wherein said first seal means includes a frame disposed along at least a portion of said edge of said first cover, said frame having top, bottom, and first and second side surfaces, said frame including a first lengthwise groove adapted for receiving said edge portion, said first groove disposed in a portion of both said top and said first side surface of said frame, said first groove having a well which is adapted for holding a sealant, said well being constructed and arranged such that at least a portion of both said one side surface and said end surfaces of said edge portion of said first cover are adjacent said well and thereby secured in said frame by said sealant.

12. The apparatus according to claim 1, wherein said first seal means includes a flexible gasket disposed between said first cover and said base, and wherein said first seal means further includes means for preventing overtightening of said flexible gasket by the user.

13. The apparatus according to claim 1, wherein said second seal means includes a flexible gasket disposed between said second cover and said base, and wherein said second seal means further includes means for preventing overtightening of said flexible gasket by the user.

14. A sealed enclosure for containing a museum piece of the like in a protected and controlled environment, said sealed enclosure comprising:

a base having at least a portion having a substantially planar configuration with two major surfaces, said base having at least one aperture disposed therethrough and forming at least one opening in each of said two major surfaces;

a first cover positioned adjacent a first of said base surfaces and enclosing said surface opening, said base and said first cover defining an upper microclimate chamber;

first seal means for removably attaching said first cover to said first base surface, and for preventing outside air flow into said upper microclimate chamber;

a second cover positioned adjacent a second of said base surfaces and enclosing said surface opening, said base and said second cover defining a lower microclimate chamber; and second seal means for removably attaching said second cover to said second base surface, and for preventing outside air flow into said lower microclimate chamber, said second seal means including a single shaft centrally disposed through said base and said second cover, said second seal means further including a flexible seal disposed between said second cover and said base, said shaft and said flexible seal being the only attachment of said second cover to said base.

15. The sealed enclosure according to claim 14, wherein said first cover is substantially transparent.

16. The sealed enclosure according to claim 14, wherein said second cover includes a humidity buffer.

17. The sealed enclosure according to claim 14, wherein said first cover has sides partially enclosing an open interior, said sides having edges surrounding the perimeter of the opening to the interior, said edges having inner surfaces facing inside said cover and end surfaces adjacent to and substantially perpendicular to said inner surfaces, wherein said first seal means includes a frame disposed along at least a portion of at least one of said edges of said first cover, said frame having a top, bottom, interior, and exterior surfaces, said frame being affixed to said edge portion such that said interior surface of said frame is disposed inside said first cover, said frame including a first lengthwise groove for receiving said edge portion, said first groove disposed along at least a part of a corner of said frame such that said first groove lies in a portion of both said top and exterior frame surfaces, said first groove having a shape defining a well which is adapted for holding a sealant, said well being constructed and arranged such that at least a portion of both said inner and end surfaces of said edge portion of said first cover are adjacent said well and thereby secured in said frame by said sealant.

18. The sealed enclosure according to claim 14, wherein said first seal means includes a frame disposed along at least a portion of said exposed edges of said first cover, said frame including means for clamping said frame to said base.

19. The sealed enclosure according to claim 14, wherein said base is adapted to be mounted on a pedestal, and wherein said second cover is constructed and arranged to be within the perimeter of said base such that said second cover is completely enclosed within said pedestal when mounted.

20. The sealed enclosure according to claim 14, wherein said first seal means includes a flexible gasket disposed between said first cover and said base, and wherein said first seal means further includes means for preventing overtightening of said flexible gasket by the user.

21. The sealed enclosure according to claim 14, wherein said second seal means includes a flexible gasket disposed between said second cover and said base, and wherein said second seal means further includes means for preventing overtightening of said flexible gasket by the user.

22. A sealed case for containing a museum piece or the like in a protected and controlled environment, said sealed case comprising:

a base having a substantially planar configuration with two major surfaces, said base having at least one aperture disposed therethrough and forming at least one opening in each of said two major surfaces;

a top cover positioned on a first of said base surfaces and enclosing said surface opening, said base and said top cover defining an upper microclimate chamber;

first seal means for removably attaching said top cover to said first base surface, and for preventing outside air flow into said upper microclimate chamber;

a bottom cover positioned on a second of said base surfaces and enclosing said surface opening, said base and said bottom cover defining a lower microclimate chamber;

second seal means for removably attaching said bottom cover to said second base surface, and for preventing outside air flow into said lower microclimate chamber; and means for closing at least one of said apertures in said base, said closing means being operable from outside said second microclimate chamber.

23. The sealed case according to claim 22, further comprising means for adjusting said second microclimate without the removal of said bottom cover or said top cover.

24. The sealed case according to claim 22, wherein said means for closing at least one of said apertures is a rotatable disc positioned substantially adjacent said second surface of said base and entirely within said bottom cover.

25. The sealed case according to claim 22, wherein said second seal means includes a shaft centrally disposed through said base and said bottom cover.

26. The sealed case according to claim 25, wherein said means for closing at least one of said apertures is coupled to said centrally disposed shaft.

27. A sealed case having a frame for mounting a cover to a base, said sealed case comprising:

a cover having at least one peripheral edge, said edge having an end surface and at least one side surface adjacent to and substantially perpendicular to said side surface;

a frame disposed along at least a portion of said edge of said cover, said frame having top, bottom, and first and second side surfaces, said frame including:

a first lengthwise groove adapted for receiving said edge portion, said first groove disposed in a portion of both said top and said first side surface of said frame, said first groove having a well which is adapted for holding a sealant, said well being constructed and arranged such that at least a portion of both said one side surface and said end surfaces of said edge portion of said cover are adjacent said well and thereby secured in said frame by said sealant;

means for sealing said bottom surface of said frame to said base; and means for clamping said frame to said base.

28. The sealed case according to claim 27, wherein said cover is substantially transparent, and wherein said sealed case is adapted for containing an object on display.

29. The sealed case according to claim 27, wherein said clamping means includes a second groove in said frame, said second groove positioned in said exterior surface of said frame, said clamping means further including a clamp member having a projection adapted to be received in said second groove of said frame and adapted to attach said frame to said base.

30. The sealed case according to claim 27, wherein said sealing means includes a bottom groove in said frame, said bottom groove positioned in said bottom surface of said frame, said sealing means further including a flexible seal disposed within said bottom groove.

31. The sealed case according to claim 27, wherein said clamping means includes means for securing said frame to said base from above or below said base.

32. The sealed case according to claim 27, wherein said sealing means further comprises cover means for concealing at least a portion of said clamping means.

33. The apparatus according to claim 1, wherein said base is constructed from a singular block of solid nonporous material.

34. The apparatus according to claim 1, wherein said base has at least two major surfaces disposed in a substantially parallel and opposing relationship.

35. The apparatus according to claim 34, wherein said base has a substantially flattened shape such as a plate or disk.

36. The apparatus according to claim 35, wherein said two major surfaces of said base are oriented substantially horizontally in said support means such that said first cover is positioned on a top surface of said base and such that said second cover is positioned on a bottom surface of said base.

37. The apparatus according to claim 1, wherein at least a portion of said first cover is substantially transparent for displaying said object.

38. The apparatus according to claim 37, wherein said first cover is constructed substantially in the shape of a rectangular parallelepiped.

39. The apparatus according to claim 1, wherein said sealed enclosure is adapted to be separated from said support means without opening either of said first and second microclimate chambers.

40. The sealed enclosure according to claim 14, wherein said base is adapted to be mounted on a pedestal, and wherein said pedestal provides the sole support for said sealed enclosure by being attached to said base such that said sealed enclosure is adapted to be separated from said pedestal without opening either of said first and second microclimate chambers.

41. The sealed enclosure according to claim 14, further comprising means for closing at least one of said apertures in said base.

* * * * *